United States Patent [19]

Steinback

[11] 4,399,637

[45] Aug. 23, 1983

[54] ABRASIVE GRINDING MACHINE

[75] Inventor: Clarence I. Steinback, Edina, Minn.

[73] Assignee: Acrometal Products, Inc., Minneapolis, Minn.

[21] Appl. No.: 227,548

[22] Filed: Jan. 23, 1981

[51] Int. Cl.[3] ..... B24B 21/04

[52] U.S. Cl. ..... 51/138; 51/76 R; 51/215 E

[58] Field of Search ..... 51/138, 139, 76 R, 215 E

[56] References Cited

U.S. PATENT DOCUMENTS

| | | | |
|---|---|---|---|
| 2,316,582 | 4/1943 | Hercik | 51/139 |
| 2,876,600 | 3/1959 | Pendergast | 51/139 |
| 3,208,187 | 9/1965 | Ernst | 51/138 |
| 3,394,501 | 7/1968 | Carlson | 51/138 |

*Primary Examiner*—Harold D. Whitehead

*Attorney, Agent, or Firm*—Merchant, Gould, Smith, Edell, Welter & Schmidt

[57] ABSTRACT

An abrasive grinding machine (11) is disclosed which comprises workpiece conveying means (14) carried in a horizontal position by a frame (12) with a grinding head (15) disposed in overlying relation thereto. The conveying means (14) includes a flexible endless conveyor belt (22) the upper flight of which passes over a rigid planar backing surface. The grinding head (15) includes an abrasive belt (27) that moves in a direction opposite the conveyor belt (22). A back-up roller (31) is rotatably disposed in a recess (21) in the bed (13) in opposition to a drive roller (28) of the grinding head (15). The back-up roller (31) slightly elevates the conveyor belt (22) from the rigid support surface of the bed (13). The belt (22) is thus able to deflect and conform to a warped or twisted workpiece as it moves through the grinding area, resulting in uniform deslagging of each workpiece.

20 Claims, 3 Drawing Figures

ABRASIVE GRINDING MACHINE

TECHNICAL FIELD

The invention broadly relates to abrasive grinding machines and is specifically directed to such a machine for grinding the slag from torch-cut plate members.

BACKGROUND OF THE INVENTION

The manufacture of many articles both large and small involves the use of metal plate components. One of the more efficient processes used in the fabrication of heavy metallic plate components is torch cutting. Multiple head torch cutting devices are now commonly used, and they permit the formation of a plurality of metal plate members both regular and irregular in configuration.

While torch cutting is one of the more efficient approaches to obtaining metal plate components of a desired shape, a problem results from the fact that, during the process, the plate momentarily reaches a melting temperature in the cutting area, producing slag along the edge of the component. The slag must be removed prior to use of the plate component in the fabrication process.

In addition to other grinding and surfacing functions, abrasive grinding machines have been found to be quite suitable for removing slag from such metal plate components. Slag grinding machines typically consist of an elongated, horizontal bed disposed approximately at the waist level of an operator and an endless belt that moves longitudinally over the bed for carrying the metal plate workpieces. An abrasive grinding head is carried by the machine frame in overlying relation to the bed and endless conveyor belt, itself consisting of a relatively wide endless abrasive belt that moves around a drive roller and one or more idler rollers. The grinding portion of the grinding head is disposed in spaced relation to the conveyor belt and elongated bed, and the abrasive belt normally moves in a direction opposite that of conveyor belt movement. Thus, as the workpieces are carried through the grinding area by the conveyor belt, they are engaged by the oppositely moving abrasive belt, which quickly removes the slag.

It is of course necessary for the elongated bed to provide a relatively rigid backing support to the workpiece in direct opposition to the grinding head in order for the workpiece to be forced into grinding engagement with the abrasive belt. Consequently, the elongated bed of a conventional slag grinding machine is continuously rigid over its length, or at the very least through the grinding area.

Slag grinding machines as described operate quite efficiently so long as the metal plate components are flat, since the planar backing surface of the elongated bed uniformly urges the plate component against the grinding head, uniformly removing the irregularly formed slag from all edge surfaces. A significant problem arises, however, if the plate components have become warped even to a minimal degree, which is quite common because of the heat involved in the torch cutting process. It will be readily appreciated that a warped metal plate passing through the grinding area over a fixed planar bed cannot be uniformly urged against the grinding head. If a slightly concave surface is subjected to the grinding head, the mid or low areas will not be completely ground, leaving an amount of slag. If the convex surface of the warped plate member is exposed to the grinding head, the mid-portion will be ground, but the ends or sides will be incompletely surfaced.

The problem is relatively acute even though the warpage is minimal, since a component having residual slag cannot be used in the fabrication unless this remaining slag is removed by hand.

SUMMARY OF THE INVENTION

The invention is therefore directed to an abrasive grinding machine specifically intended for the removal of slag from metal plate workpieces whether warped or unwarped.

The invention specifically resides in the provision of means for permitting a warped plate to be deflected nonrigidly from the rigid planar support surface of the elongated bed just prior to the point of grinding and immediately thereafter. This is specifically accomplished by elevating the conveyor belt slightly above the planar surface of the bed so that the belt is deflectably spaced from the bed, while at the same time providing a rigid region of back support for the workpiece in direct opposition to the grinding head.

In the preferred embodiment, the grinding head comprises an endless belt the width of which corresponds to the width of the conveyor belt. The endless abrasive belt is driven around a drive roller and an idler roller, both of which rotate about axes that are preferably perpendicular to the line of workpiece movement. The drive roller is disposed in adjustable spaced relation over the conveyor belt and bed and defines a line or narrow region of abrasive contact with the workpiece. The drive roller is generally rotated in a direction so that the abrasive belt moves against the direction of workpiece movement.

In the preferred embodiment, the means for elevating the conveyor belt from the elongated bed comprises a back-up roller that is mounted in a recess formed within the bed in the grinding area. The back-up roller is an idler, and is disposed in spaced, parallel relation with the drive roller of the grinding head. The back-up roller projects slightly above the planar surface of the bed, thus elevating the conveyor belt from the bed by a predetermined amount. Preferably, the back-up roller is mounted for vertical adjustment to vary the degree of elevation of the conveyor belt from the bed.

As constructed, the back-up roller provides a rigid line or narrow region of back-up support to the workpiece in its area of belt contact, which is in direct opposition to the drive roller. This means that, when the workpiece moves into abrasive engagement with the grinding head, grinding will occur along the transverse line or narrow region where the workpiece is pressed by the back-up roller against the drive roller and abrasive belt. However, immediately prior to this line or narrow region of abrasive contact, the plate workpiece has a limited amount of free movement because the flexible conveyor belt is spaced from the rigid support bed. This deflectability of the conveyor belt is also present immediately after or beyond the grinding area, so that the workpiece is given the opportunity to move somewhat freely on both sides of the grinding area. In essence, the machine conforms to the warpage and other irregularity of the plate.

As a result, I have found that slag formed on a torch cut metal workpiece may be uniformly and efficiently removed with the inventive combination, even though the workpiece may be warped or has other irregularities in its surface.

The invention may be incorporated in any abrasive grinding machine for surfacing, grinding and machining of workpieces have nonplanar defects or irregularities, and is not limited to the slag grinding of torch-cut metal workpieces.

DESCRIPTION OF THE PREFERRED EMBODIMENT

Figure 1:
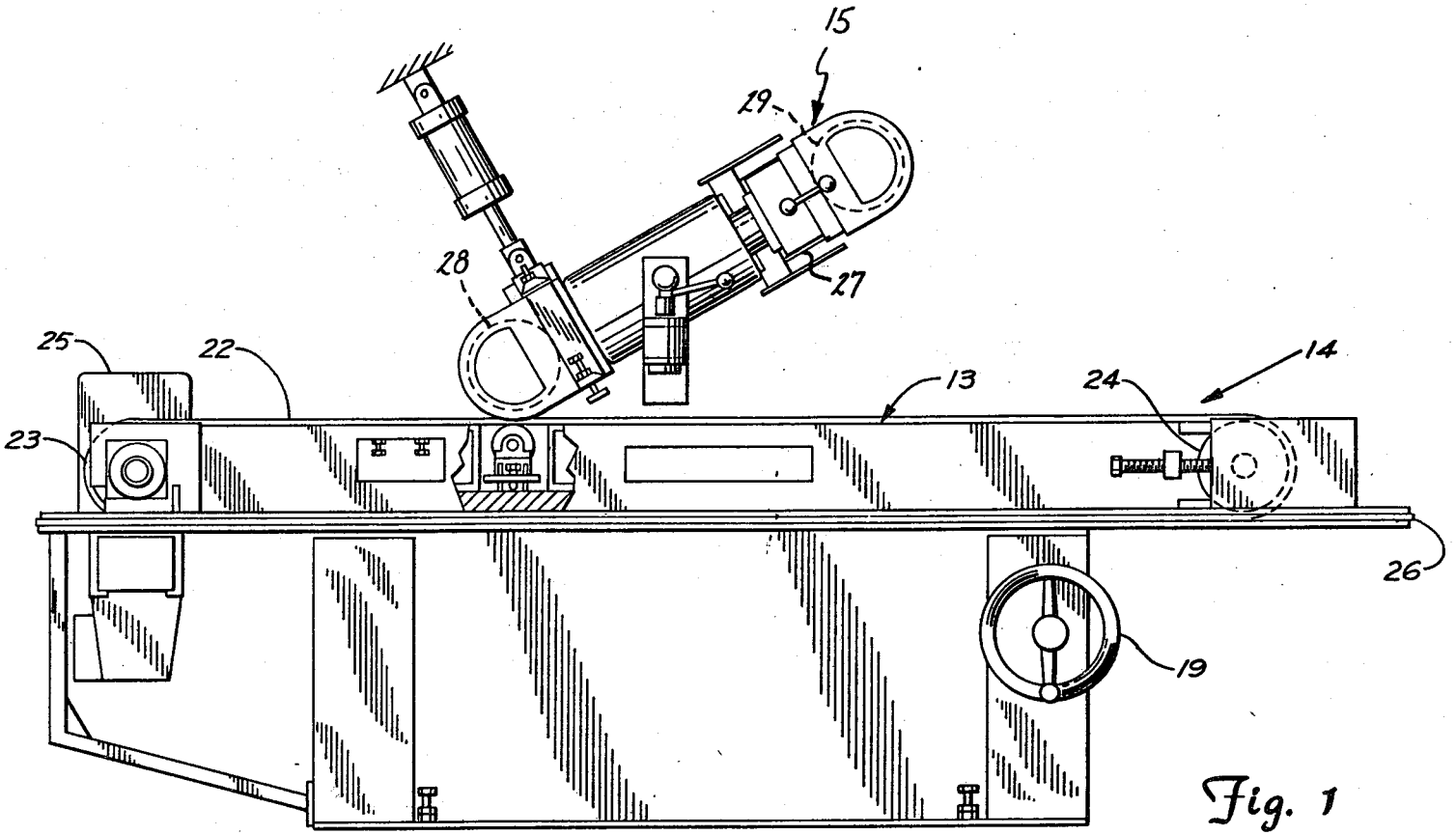
FIG. 1 is a view in side elevation of an abrasive grinding machine embodying the subject invention.

With reference to the figures, an abrasive grinding machine embodying the invention is represented generally by the numeral 11. Machine 11 broadly comprises a frame 12 that carries an elongated, horizontal bed 13, workpiece conveying means 14 for moving workpieces over the bed 13 and an abrasive grinding head 15 disposed in overlying relation to the bed 13 and conveying means 14.

The bed 13 comprises first and second elongated, rectangular box members 16, 17 that are commonly supported by an elongated base member 18. The base member 18 is movably mounted to the frame 12 by means not specifically shown, and vertical adjustment to accommodate workpieces of varying thickness is accomplished through an adjustment wheel 19.

Figure 2:
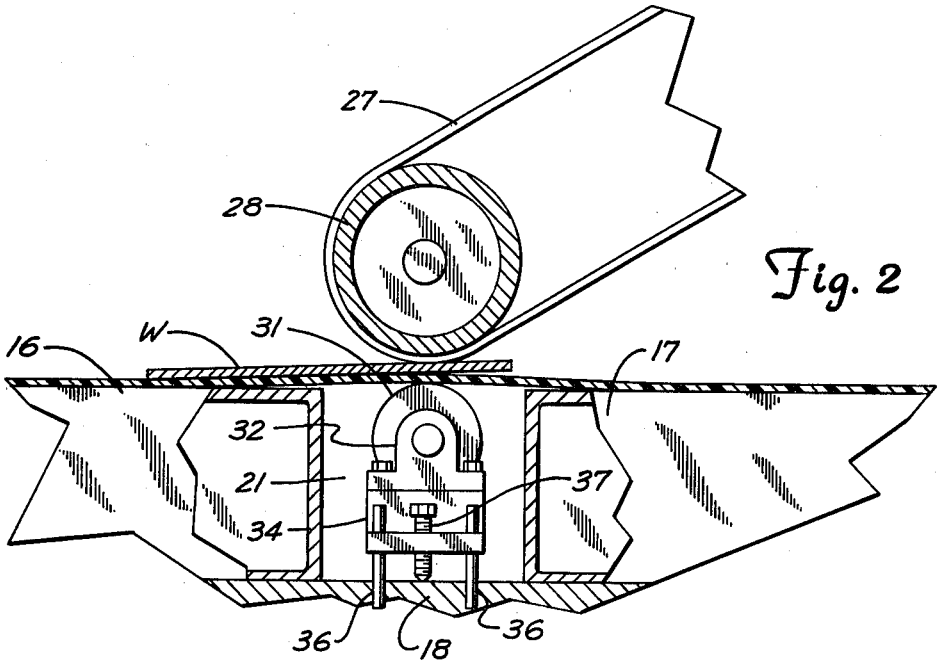
FIG. 2 is an enlarge fragmentary sectional view in side elevation of the abrasive grinding area of the machine.

With specific reference to FIG. 2, the rectangular box members 16, 17 define coplanar top surfaces 16*a*, 17*a*, respectively, which generally define an elongated, horizontal support surface over which the conveying means 14 and workpieces may move. The box members 16, 17 are spaced apart to define a recess 21 therebetween which lies immediately below the lower end of the abrasive grinding head 15.

The workpiece conveying means 14 comprises an endless conveyor belt 22 supported in tension around a drive roller 23 and an idler roller 24 respectively mounted at the ends of the rectangular box members 16, 17. The drive roller 23 is driven by an electric motor drive 25 the details of which are not essential to this invention.

The electric motor drive 25 is controlled from a control panel, not shown. The operator may stop the motor drive 25 and workpiece conveying means 14 by bumping a continuous perimeter safety switch 26.

The abrasive grinding head 15 of the preferred embodiment comprises an endless abrasive belt 27 mounted for movement between a lower drive roller 28 and an upper idler roller 29. Grinding head 15 is pivotally mounted to the frame 12 about a transverse axis intermediate its ends and the lower end, including the drive roller 28, is normally urged downward into abrasive engagement with a workpiece by a pneumatic cylinder (not shown). This type of suspension enables the grinding head to "float," i.e., to move up and down somewhat resiliently without tipping.

Abrasive grinding head 15 is driven by an electric motor drive (not shown), and includes various other adjustments for proper belt tension and location.

The workpiece conveying means 14 is driven so that the upper flight of conveyor belt 22 moves from right to left in FIG. 1. Drive roller 28 of abrasive grinding head 15 is driven in a direction so that, in the grinding area, the abrasive belt 27 moves in a direction opposite that of the conveyor belt 22. The linear velocity of abrasive belt 27 is greater than that of the conveyor belt 22 to insure complete grinding of each workpiece even though it is carried at a relatively fast speed through the grinding area by the conveyor belt 22.

With specific reference to FIG. 2, a back-up roller is disposed in the recess 21 in parallel opposed relation to the drive roller 28 of grinding head 15. Back-up roller 31 is mounted for idling rotation between a pair of journals 32, 33 (see also FIG. 3). The journals 32, 33 are respectively mounted to a pair of vertical adjustment brackets 34, 35. Bracket 34 is exemplary of the two, being vertically and slidably mounted on a pair of guide pins 36 that are fixed in the base member 18. An adjustment bolt 37 is carried by the bracket 34 for adjustable bearing relation with the base member 18.

The bracket 35 rides on identical guide pins 38 and includes an identical vertical adjustment bolt 39.

Figure 3:
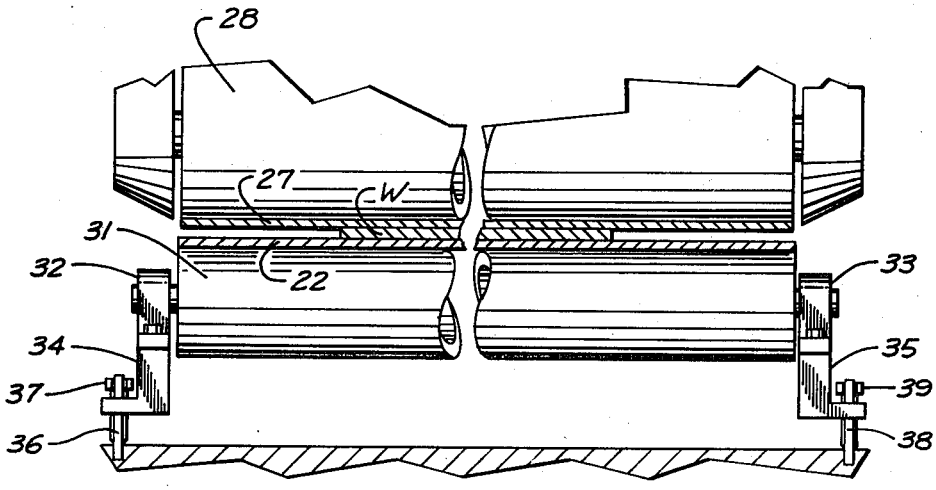
FIG. 3 is a fragmentary sectional view taken along the line 3—3 of FIG. 2.

The adjustment bolts 37, 39 are identically adjusted so that the back-up roller 31 is in parallel relation with the drive roller 28 of grinding head 15, as particularly shown in FIG. 3. As shown in FIG. 2, this adjustment causes the back-up roller 31 to project slightly above the planar surface defined by the rectangular boxes 16, 17, and thus elevates the conveyor belt 22 slightly above this planar support surface on each side of the roller 31. In the preferred embodiment, the spacing between the conveyor belt and the planar support surface is 0.020–0.125 inches.

In operation, slag bearing metal plate workpieces W are manually fed by an operator at the inlet side of the workpiece conveying means 14; the right side of the machine as viewed in FIG. 1. The workpieces are carried forward to the grinding area, and the grinding or deslaging process occurs as the workpiece W passes by in abrasive engagement with the oppositely moving abrasive belt 27. Grinding or deslagging occurs because the workpiece W is pinched or pressed into relatively nonresilient engagement by the back-up roller 31. Because the rollers 28, 31 are disposed in parallel, opposed relation, the grinding or deslagging takes place along a line or narrow region on the workpiece W, as best shown in FIG. 2.

If the workpiece W is warped or twisted, the conveyor belt may be deflected in conformance to the part by an amount corresponding to its spacing above the planar support surface. This occurs both before and after the grinding operation, thus enabling the warped plate to pass through the grinding area as a function of its warped configuration and not the planar configuration of the support surface. As such, the workpiece W is uniformly ground and the slag is uniformly removed from all edges.

Because the grinding head 15 is air loaded onto the workpiece, there is generally a substantial amount of friction with conventional machines between the conveyor belt and the stationary bed. Elevation of the conveyor belt 22 from the support bed advantageously reduces this friction in the grinding area, while at the same time maintaining the line or narrow region of abrasive engagement with the grinding head 15.

I have found that the improved abrasive grinding machine as described above permits uniform deslagging of metal components quickly and efficiently even where the component is warped or twisted to a degree.

The invention may also be incorporated in other abrasive grinding machines for surfacing, grinding, machining or dimensioning workpieces having nonplanar defects or irregularities.

What is claimed is:

1. An abrasive grinding machine comprising:

(a) a bed defining a substantially planar longitudinal support surface;

(b) endless flexible conveyor belt means longitudinally movable over the planar support surface to carry workpieces thereover;

(c) grinding head means overlying the support surface and conveyor belt means in predetermined spaced relation thereto and defining a grinding area therewith for grinding workpieces as they are carried thereby;

(d) and means disposed in direct opposition to the grinding area for pressing each workpiece into abrasive contact with the grinding head means at said grinding area, and for elevating the flexible conveyor belt means and each workpiece from said support surface in said grinding area, whereby the flexible conveyor belt means is deflectable by the workpiece as it approaches and leaves the grinding area.

2. The machine defined by claim 1, wherein the grinding head means comprises endless abrasive belt means movably supported by a plurality of rollers.

3. The machine defined by claim 2, wherein the width of the abrasive belt means corresponds generally to the width of the conveyor belt means.

4. The machine defined by claim 2, wherein the abrasive belt means is movably supported by a drive roller and an idler roller, the drive roller being disposed in the grinding area.

5. The machine defined by claim 4, wherein a recess is formed in said bed, and the means for elevating the conveyor belt means comprises a back-up roller disposed in said recess in opposition to the drive roller of said grinding head means, the back-up roller projecting above the longitudinal support surface to elevate the conveyor belt means.

6. The machine defined by claim 5, wherein the drive roller of the grinding head means and the back-up roller are disposed in parallel opposed relation.

7. The machine defined by claim 6, wherein the back-up roller is mounted for vertical adjustment relative to the longitudinal support surface to vary the spacing of the conveyor belt means thereabove.

8. The machine defined by claim 7, wherein the conveyor belt means is elevated above the longitudinal support surface 0.020–0.125 inches.

9. The machine defined by claim 1, which further comprises means for vertically adjusting the means for elevating the conveyor belt means from the longitudinal support surface.

10. The machine defined by claim 1, wherein the conveyor belt means is elevated above the longitudinal support surface 0.020–0.125 inches.

11. The machine defined by claim 1, wherein a recess is formed in said bed, and the means for elevating the conveyor belt means comprises a back-up roller disposed in said recess that projects above the longitudinal support surface.

12. The machine defined by claim 11, wherein the back-up roller is mounted for vertical adjustment relative to the longitudinal support surface to vary the spacing of the conveyor belt means thereabove.

13. The machine defined by claim 1, wherein the grinding head means is resiliently urged into grinding engagement with the workpieces.

14. The machine defined by claim 13, in which the backup roller is mounted in a fixed position relative to the planar support surface.

15. An abrasive grinding machine comprising:

(a) frame means;

(b) a bed carried by the frame means and defining a substantially planar longitudinal and horizontal support surface;

(c) roller means rotatably mounted at each end of the bed;

(d) a flexible endless conveyor belt encircling the roller means and bed under predetermined tension;

(e) means for driving the endless conveyor belt;

(f) a grinding head carried by the frame means in overlying relation to the support surface and endless conveyor belt and defining a grinding area therewith for grinding workpieces as they are carried thereby, the grinding head comprising first and second rollers, an endless abrasive belt encircling the rollers and means for driving the belt, the first roller being disposed in the grinding area;

(g) a recess formed in said bed in the grinding area;

(h) and a back-up roller rotatably disposed in a fixed position within said recess in parallel relation to said first roller, and in direct opposition to the first roller so that the workpiece is pinched therebetween during abrasive engagement the back-up roller projecting above said longitudinal support surface to elevate the endless conveyor belt and workpiece thereabove a predetermined amount whereby the flexible conveyor belt is deflectable by the workpiece as it approaches and leaves the grinding area.

16. The machine defined by claim 15, wherein the endless conveyor belt is driven in a first direction, and the endless abrasive belt is driven in the opposite direction.

17. The apparatus defined by claim 15, wherein the back-up roller is mounted for vertical adjustment relative to the longitudinal support surface to vary the spacing of the endless conveyor belt thereabove.

18. The machine defined by claim 15, wherein the endless conveyor belt is elevated above the longitudinal support surface 0.020–0.125 inches.

19. The machine defined by claim 15, wherein the grinding head is resiliently urged into grinding engagement with the workpiece.

20. The machine defined by claim 19, which further comprises means for adjusting the fixed position of said backup roller.

* * * * *